United States Patent [19]

Lagimoniere

[11] Patent Number: 4,662,848

[45] Date of Patent: May 5, 1987

[54] SWING-OPERATED PADDLE-WHEEL WATER-CRAFT

[76] Inventor: Guy Lagimoniere, 9 Fernandel St., Apt. 4, Granby, Canada, J2G 8A6

[21] Appl. No.: 655,539

[22] Filed: Sep. 28, 1984

[51] Int. Cl.[4] ..... B63H 21/00

[52] U.S. Cl. ..... 440/21; 114/363; 440/32

[58] Field of Search ..... 114/58, 363; 440/21-32, 90

[56] References Cited

U.S. PATENT DOCUMENTS

| | | | |
|---|---|---|---|
| D. 159,204 | 7/1950 | Heels et al. | 440/30 |
| 818,986 | 4/1906 | Tubbs | 114/363 |
| 929,174 | 7/1909 | Thibert | 440/32 |
| 1,370,959 | 3/1921 | Greer | 440/31 |
| 2,751,876 | 6/1956 | Ogilvie | 440/25 |
| 2,827,871 | 3/1958 | Hatzi | 440/31 |

FOREIGN PATENT DOCUMENTS

| | | | |
|---|---|---|---|
| 2542440 | 3/1977 | Fed. Rep. of Germany | 440/24 |
| 947334 | 6/1949 | France | 440/24 |
| 386272 | 4/1965 | Switzerland | 440/26 |

*Primary Examiner*—Sherman D. Basinger
*Assistant Examiner*—Stephen P. Avila

[57] ABSTRACT

A water-craft which comprises a swing assembly including opposed seats and a foot-rest arranged to each make a reciprocative movement and a transmission mechanism to convert the reciprocating movement of the seats into a rotary movement to actuate a paddle-wheel for propelling the craft. The transmission mechanism includes reciprocating pairs of angularly adjustable one-way grippers which grip an endless belt for moving the latter in one direction or in the other or which clear the belt to propel the craft forwardly or rearwardly, or to permit use of the swing assembly while the craft remains stationary.

6 Claims, 18 Drawing Figures

46
12
10
1
2
12
11
19
12'
2'
12
12'
3'
9'
4
20
9
22
20
12
3
3'

11
10
46
6
9
20
12
12
1
3'
4
3
6
3'

12
9'
12
1
2
20
21
4
4
10
9
20
22
11
12
3

SWING-OPERATED PADDLE-WHEEL WATER-CRAFT

FIELD OF THE INVENTION

The present invention relates to small water-craft, more specifically to a craft of such type obtaining its propelling force from a paddle wheel or propeller screw operated by human power.

BACKGROUND OF THE INVENTION

Small water-crafts obtaining their propulsion from a foot-operated paddle wheel or propeller are well known, being sometimes referred to as "pedalos". In such water-crafts, the occupants sit on a bench or seat and push pedals as are ordinarily provided on a bicycle to move the craft forward. Although the intent of having such a water-craft is directed to pleasure and recreation, the pedalling can become relatively strenuous exercise over intermediate distances, especially so for children and older people.

OBJECTS OF THE INVENTION

The principal object of the present invention is to provide a paddle wheel water-craft in which the paddle wheel or propeller screw is rotated by reciprocated movement of the seats and foot-rest, as in a lawn swing.

It is another important object of the present invention to provide a water-craft of the above type, wherein much less physical effort is required to move the craft in comparison to pedal-operated crafts.

It is yet another object of the present invention to provide a water-craft of the above type, having transmission means to reverse the rotational direction of the paddle wheel or propeller, the same means having a neutral position, whereby the occupant (s) can swing back and forth on the craft without displacing the same in the water.

It is still another object of the invention to provide a water-craft of the above type, which is simple in design, sturdy, long-lasting and very pleasurable to ride on.

SUMMARY OF THE INVENTION

The above and other objects and advantages of the instant invention are realized according to a preferred embodiment that contemplates a small water-craft having a hull preferably taking the form of a pair of parallel and spaced-apart pontoons. They are rigidly secured together by a rectangular base including a rigid transverse beam at each end of the base and a pair of rigid spaced-apart longitudinal beams. The base extends over the top surfaces of the pontoons.

Each of the four corners of the base is provided with an upstanding post. Each post rigidly supports, at its upper end, a longitudinally-oriented arcuate track which is upwardly concave.

A rectangular platform or deck frame, spaced slightly above the base, is arranged for reciprocal movement relative to the base and pontoons. All four corners of this deck frame are provided with vertical standards, each of the latter rotatively carrying a roller having a transverse axis and located adjacent the inner upper surface of its associated standard. The rollers are adapted to roll along the arcuate tracks.

A rectangular seat-carrying frame is formed of a pair of spaced-apart longitudinally-extending bar members and a transverse link member at each end of the bar members. The longitudinal bar members are spaced exteriorly of the longitudinal portions of the deck and are each formed with two rigid uprights located longitudinally inwardly of the transverse link members. Each of the uprights has a second arcuate track rigidly secured to their upper ends. Each of these second arcuate tracks also extends longitudinally, being downwardly curved and adapted to move over the upper circumferential portion of each associated roller. Two mutually, inwardly-facing seats or benches are rigidly secured between and to each transverse pair of the second arcuate tracks.

It will be readily understood that the above-described assembly replicates a known lawn-swing type construction, wherein the deck and the seat-carrying frame are adapted to move back and forth by pushing action of the occupant(s) of the seat(s). To initiate such reciprocal movement, one occupant pushes against the deck with his (her) feet, thereby forcing the seat on which he (she) is sitting to move in the opposition direction. Once the seat and deck begin the reciprocal motion, very little physical effort is required to keep the seats and deck moving because of the momentum created. It is also to be noted that the seats will move twice the longitudinal distance and at twice the speed of the deck.

Preferably, the rollers and all the arcuate tracks are hidden by vertical casings fixed to the base and located immediately exteriorly of both sides of both seats.

A propelling means, preferably a paddle wheel, is located adjacent one end of the craft, extending transversely of the base and under the latter between the two pontoons.

The paddle wheel is operatively connected to a transmission means that is specifically designed to convert the reciprocal movement of, preferably, the seat-carrying frame into rotational power. The transmission means could also be connected to the deck. The transmission means are manually operated by an upstanding lever handle projecting through the deck frame adjacent one of the seats.

Preferably, the transmission means includes three modes: forward, reverse and idle. In the latter mode, occupants of the craft can swing back and forth on the seats without thereby making the paddle wheel rotate.

BRIEF DESCRIPTION OF THE DRAWINGS

The above will be more clearly understood by having referral to the preferred embodiment of the invention, illustrated by way of the accompanying drawings, in which:

FIG. 13, is a side elevation of the same spring attached to the shaft of FIG. 15; FIG. 2, is a section on line 18—18 of FIG. 9.

Like numerals indicate like elements throughout the drawings.

DETAILED DESCRIPTION OF THE PREFERRED EMBODIMENT

Figure 1:
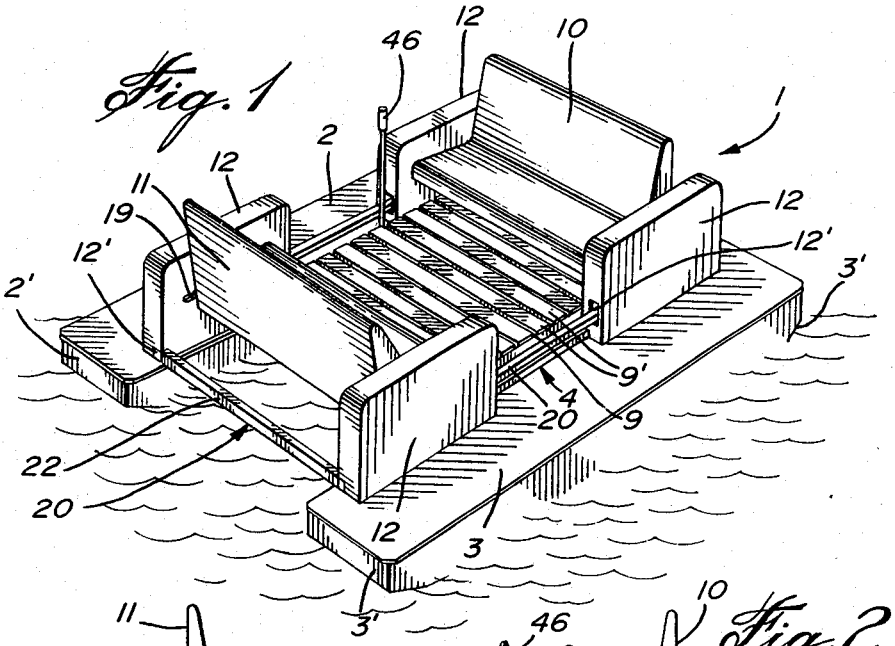
FIG. 1 is a perspective view of the water-craft according to the invention.
Figure 2:
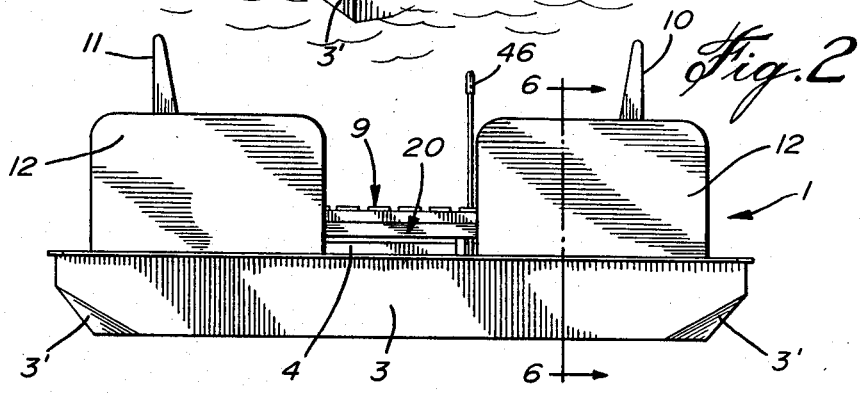
FIG. 2 is a side elevation of the water-craft of FIG. 1.
Figure 3:
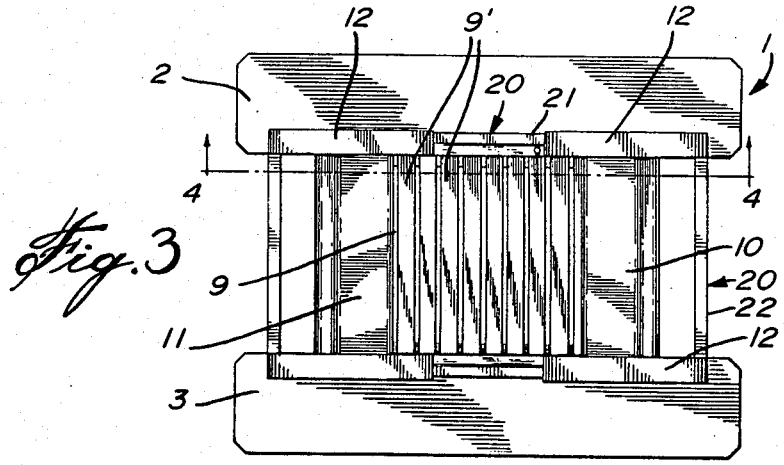
FIG. 3 is a top plan view of the water-craft.

The water-craft 1 has a structure including a pair of laterally spaced and parallel pontoons 2, 3 having upwardly-outwardly-inclined similar bottom end portions 2', 3' for movement in either direction. Pontoons 2, 3 are rigidly secured together by a flat, horizontal base 4 (seen in FIGS. 4 to 6) formed of a pair of laterally-spaced longitudinal beams 5,6, each fixedly secured to the top surface of its respective pontoon and rigidly interconnected by a pair of transverse beams 7, 8 at either end of beams 5, 6. The external elements of craft 1 further include a deck 9 composed of a plurality of longitudinally spaced slots 9' and attached to a deck frame, to be described below. A pair of mutually-facing transversely-oriented seats or benches 10,11 are located over the end areas of deck 9 but independently mounted, also to be described below. Four vertical casings 12 located on both sides of both seats 10 and 11 complete the structure.

Figure 5:
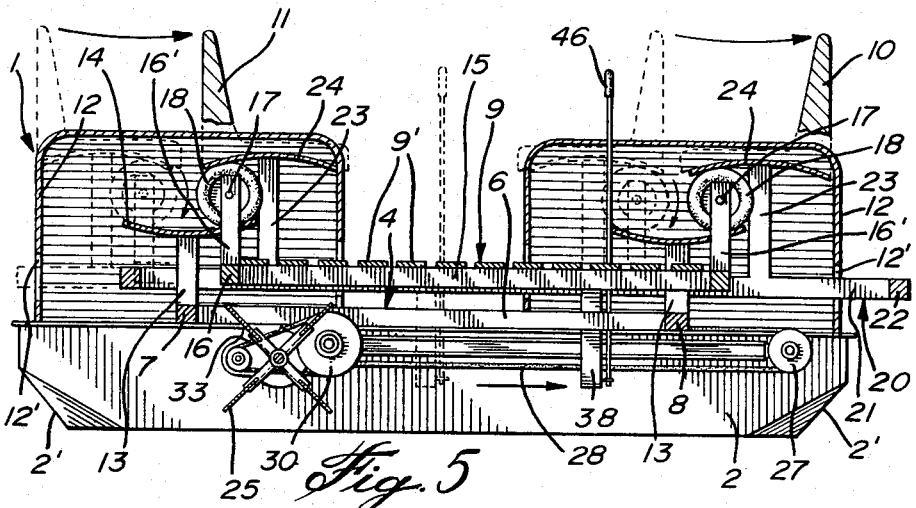
FIG. 5 is a cross-sectional view similar to that of FIG. 4 showing the seats and deck in one limit position.
Figure 4:
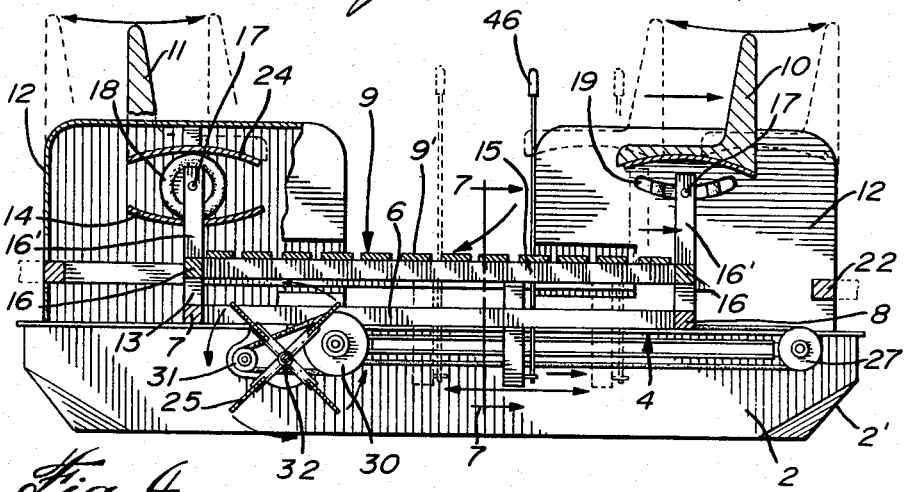
FIG. 4 is a cross-sectional elevation taken along line 4—4 of FIG. 3.
Figure 6:
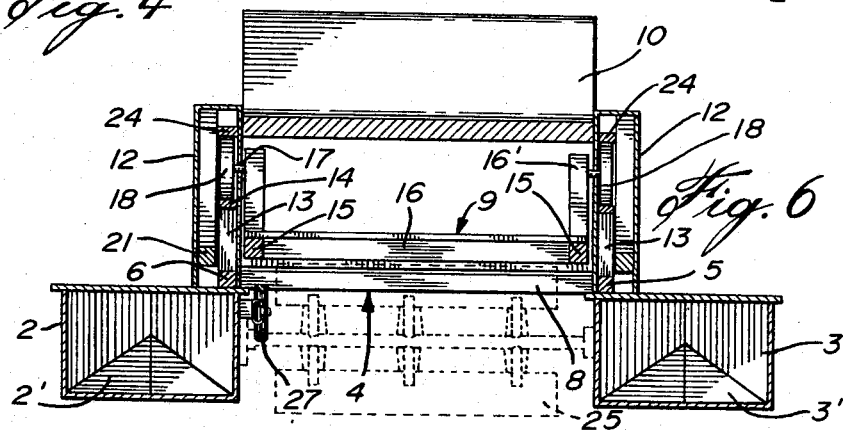
FIG. 6 is another cross-sectional view taken along line 6—6 of FIG. 2.

Referring now to FIGS. 4 to 6, there are shown the internal elements of craft 1.

Each of the four corners of base 4 is provided with an upright post 13. The upper end of each of the latter has rigidly secured thereto a first arcuate track 14 longitudinally oriented and upwardly concave.

The deck frame 9 mentioned above is formed of two spaced longitudinal members 15 and end tie members 16, thereby defining a rectangular shape spaced slightly above base 4, wherein the members 15 are located inwardly of beams 5,6 of the base and adjacent the inner sides of casings 12. Each of the four corners of the deck frame is furnished with standards 16'. The upper end portion of each of the standards 16' has a transverse axle 17 on which is rotatively mounted a roller 18 adapted to roll on its associated arcuate track 14. As seen clearly in FIGS. 1 and 4, the rollers 18 are located inside casings 12 and their respective axles 17 extend through a curved slot 19 made in each casing 12.

Seats 10 and 11 are rigidly mounted on a seat-carrying frame 20, consisting of a pair of spaced longitudinal bar members 21 rigidly connected by transverse link members 22 at their opposite ends. Bar members 21 are spaced exteriorly of the deck members 15 and located inside casings 12, extending through openings 12' made in the latter. Both bar members 21 are formed with rigid uprights 23 located longitudinally inwardly of the links 22. These uprights 23 rigidly support, at their respective upper ends, second arcuate tracks 24 that are downwardly concave and adapted to move over rollers 18. Seats 10 and 11 are carried by tracks 24 by rods extending through slots (not shown) of casings 12. When the seat-carrying frame 20 is in one limit position, as suggested in FIG. 5, the transverse link members 22 on the same side extends outwardly of its two contiguous casings 12, while the transverse link member at the opposite end is drawn inside the two other casings 12 through openings 12'.

FIGS. 4 and 5 illustrate well the back-and-forth swinging motion of deck 9 and the seat-carrying frame 20.

A propulsion means for the craft 1, preferably a paddle wheel 25, although it could be a propeller screw, is rotatably secured between the pontoons 2 and 3 adjacent one end of the craft.

Referring now to FIGS. 1 to 17, there is shown the transmission means for converting the reciprocating movement of the swing assembly to rotative power for paddle wheel 25.

A pair of longitudinally-spaced pulleys 26 and 27 are transversely journalled on the inner side of pontoon 2 immediately below base 4. Both pulleys 26, 27 have a grooved circumferential surface, being adapted to tightly and rotatively hold a first cross-sectionally V-shaped endless belt 28.

Figures 10, 11, 12:
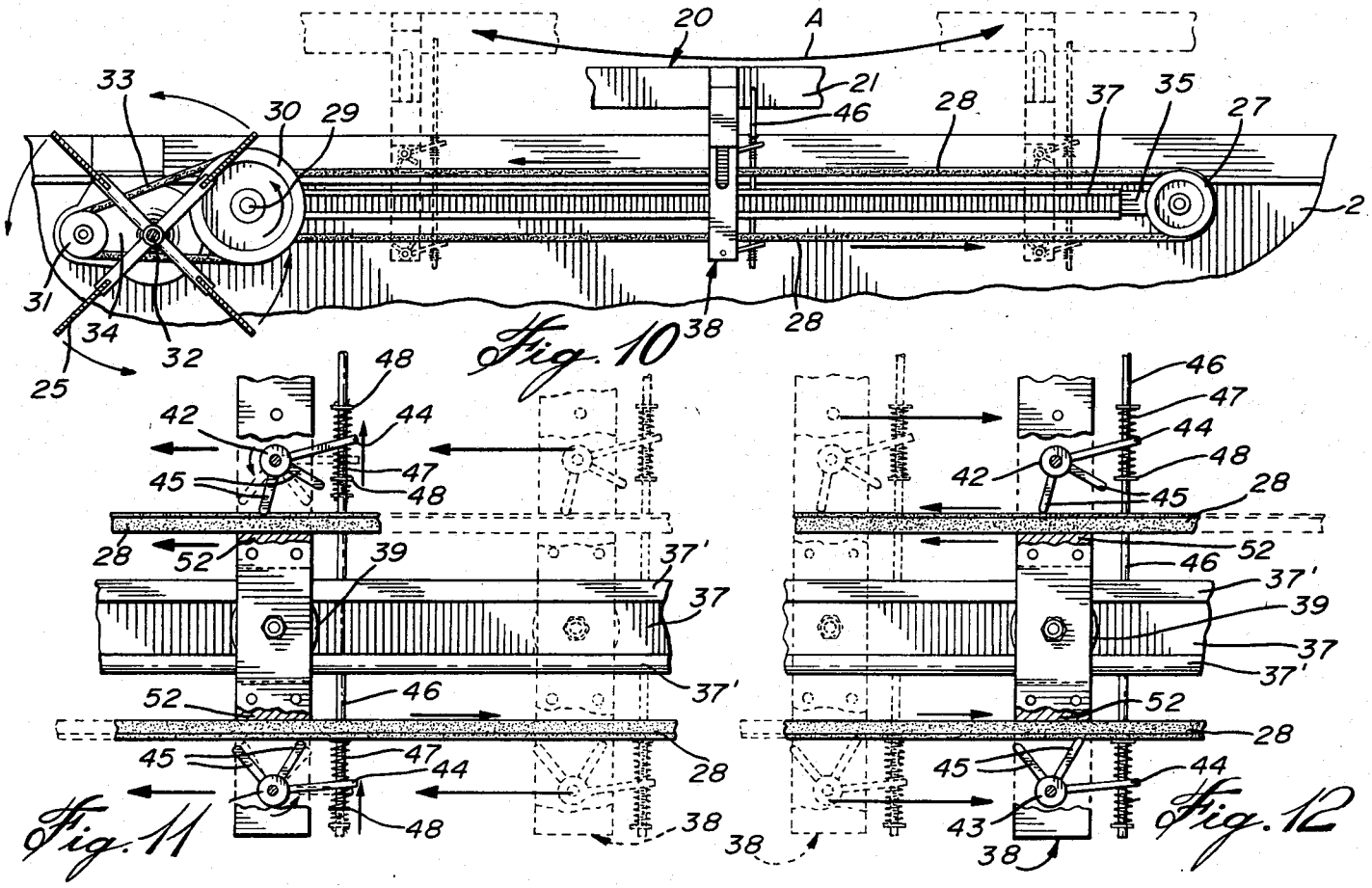
FIG. 10 is a side elevation of the entire transmission means.
FIGS. 11 and 12 are side elevations of the lever handle and its mechanism showing the reciprocal movement between two limit positions of the same.
Figure 14:
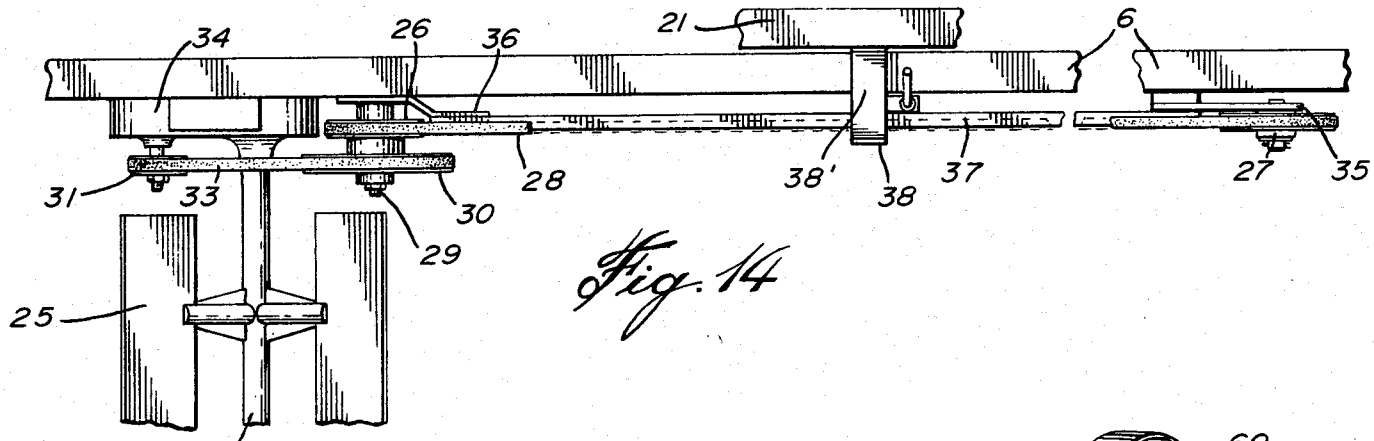
FIG. 14 is a top plan view of the transmission means and a portion of the paddle wheel.
Figure 15:
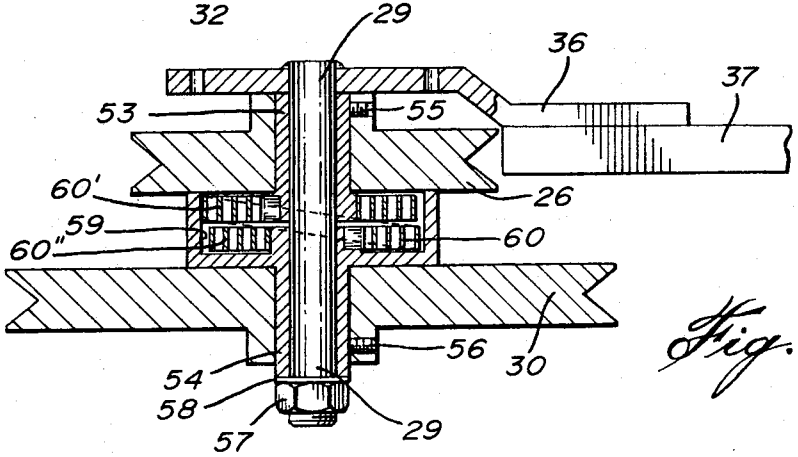
FIG. 15 is a horizontally cross-sectioned top plan view of the mechanical elements connecting the transmission means to the paddle wheel.

Specifically, FIGS. 10, 14, and 15 depict how the left side pulley 26 is mounted on a transverse shaft 29 which also carries a large pulley 30. A small pulley 31 is journalled in the inner side of pontoon 2 on the opposite side of the paddle wheel shaft 32 and is made to revolve by large pulley 30 by means of a second endless belt 33. Small pulley 31 is preferably connected to shaft 32 by the intermediary of a gear reduction mechanism (not shown) located in a housing 34, to rotate paddle wheel 25 at the desired slow speed.

Pulley 27 is supported in position by a bracket 35 rigidly secured to the inner side of pontoon 2. Bracket 35 and a second bracket 36, also secured to pontoon 2 adjacent shaft 29, rigidly support between them a longitudinal guide rail 37 having outwardly upwardly and downwardly-bent flanges 37' respectively. Rail 37 extends between the upper and lower portions of endless belt 28.

A vertical transmission arm 38 has a central transverse guide wheel 39 adapted to move in guide rail 37 between two longitudinal limit positions (seen in dotted lines in FIG. 10). Arm 38 is inwardly bent at its upper end 38' where it is rigidly secured to the adjacent bar member 21 of the seat-carrying frame 20 (see FIGS. 7 and 8). It will be clear that as bar member 21 moves back and forth with the seats, arm 38 will move bodily therewith along guide rail 37. Since the first and second arcuate tracks 14 and 24 are curved, there will also occur vertical displacement of seat frame 20, as suggested by the double arrow A of FIG. 10; consequently, arm 38 is also subject to vertical displacement. Therefore, arm 38 has a telescopic lower portion 38" which is provided with two interior bearings 40 adapted to move in a vertical slot 41 formed in the upper telescopic section 38"' of the arm.

Figure 7:
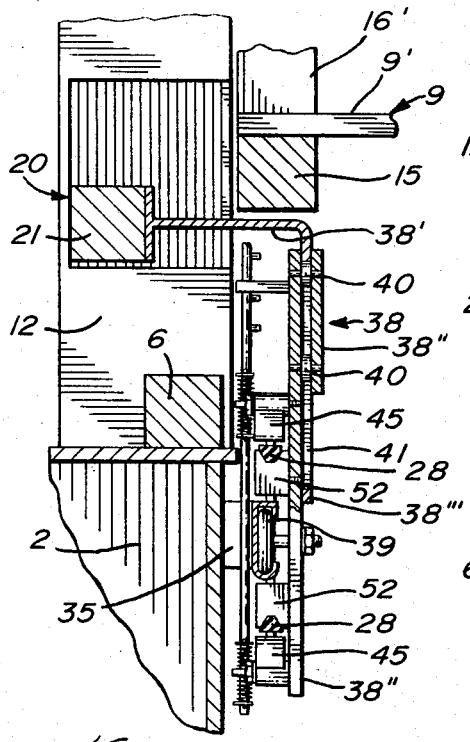
FIG. 7 is another cross-sectional view taken along line 7—7 of FIG. 4.
Figure 8:
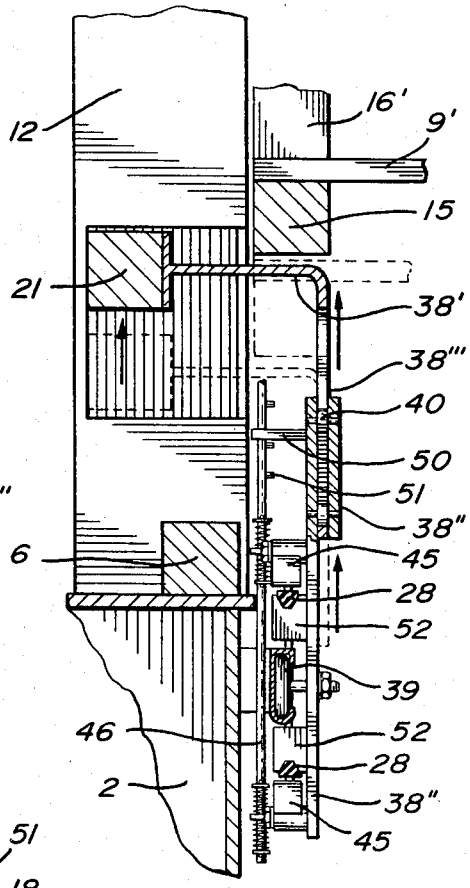
FIG. 8 is a cross-sectional view similar to that of FIG. 7 but showing the seat-carrying frame, the deck and the transmission means in a limit position.
Figure 9:
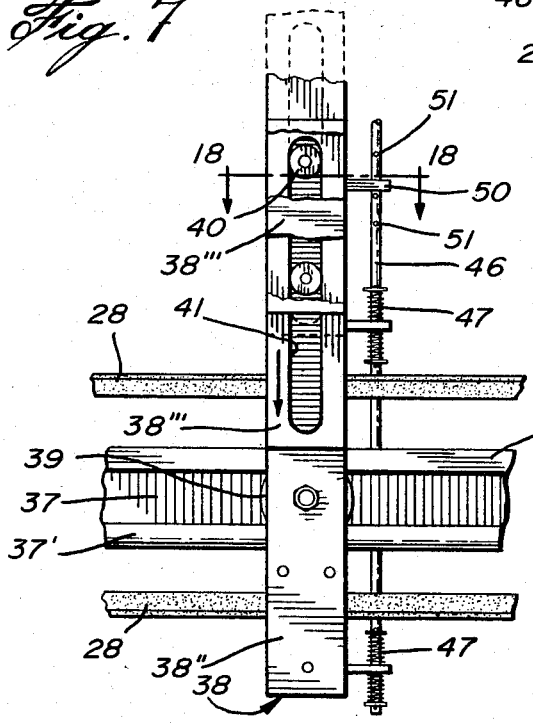
FIG. 9 is a side elevation of a portion of the transmission means.
Figure 18:
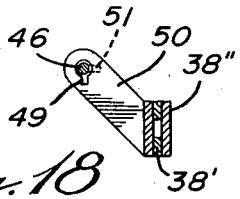
FIG. 18, on the sheet containing

This lower section 38" is provided with a pair of gripper elements 42 and 43 adjacent the upper and lower runs, respectively, of endless belt 28 (cf. FIGS. 7 to 13). Both gripper elements 42, 43 are pivotally transversely secured to section 38″ and include a radially-projecting tab 44 and two angularly-spaced one-way gripper arms 45. Tab 44 has an outer hole which slidably receives the lower portion of a vertical push-pull control rod 46, the upper portion of which extends upwardly beside the deck frame. Coil springs 47 surround control rod 46 on either side of tab 44 and are biased against the latter by washers 48 fixed to rod 46. Springs 47 resiliently bias one or the other of gripper elements 42, 43 against V-belt 28. Control rod 46 can take three axial positions: an upper position for reverse drive; an intermediate position for neutral and a lower position for forward drive. Referring to FIGS. 7, 9 and 18, control rod 46 slidably and rotatably extends through a key-shaped hole 49 of a bracket 50 fixed to lower telescopic section 38″ of transmission arm 38. Rod 46 has three spaced studs 51 which pass through hole 49 and alternately abut against bracket 50 when rod 46 is rotated one-quarter turn. Thus, rod 46 is retained in any of the three above positions.

The two gripper arms 45 of each gripper element 42, 43 define therebetween slightly less than 90° and adapted to selectively engage V-belt 28 and wedge the same against a backing shelf 52 fixed to lower section 38″ of transmission arm 38 (see FIGS. 7 and 8).

Figure 13:
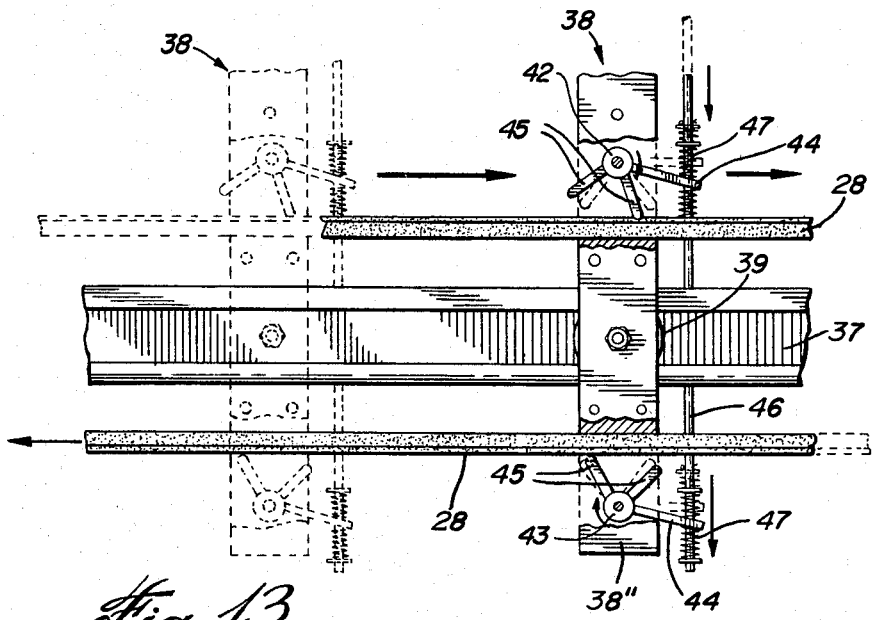
FIG. 13 is a side elevation similar to FIGS. 11 and 12 showing the reverse mode of the transmission means.

FIGS. 11 to 13 afford a view of how the transmission means functions: in FIG. 11, transmission arm 38 is moving to the left, being carried by the seat-carrying frame 20. Control rod 46 is in upward reverse position, thereby forcing the left-hand gripper 45 of upper element 42 to grip and wedge the upper run of endless belt 28 against shelf 52 and move belt 28 along with it, thereby rotating pulleys 26 and 27 in anticlockwise direction. When arm 38 reaches its leftward limit position, it will reverse direction, moving toward the right (FIG. 12). During this rightward motion, the right-hand gripper 45 of lower gripper element 43 will grip the lower run of belt 28, thereby continuing to move the latter and pulleys 26 and 27 in the same anticlockwise direction, as indicated by the arrows in both FIGS. 11 and 12. FIG. 11 shows that right-hand gripper arm 45 of lower gripper element 43 simply slides on the lower run of V-belt 28. Thus, gripper elements 42, 43 convert the reciprocal movement of arm 38 into rotational movement of the paddle wheel 25.

As mentioned above, the transmission means also has a forward mode and a neutral mode. The forward mode is shown in FIG. 13; by pushing down control rod 46, the right-hand gripper arm 45 of upper gripper element 42 grips belt 28, moving belt 28 in the opposite direction relative to FIG. 12, both FIGS. 12 and 13 illustrating the rightward motion of arm 38. Similarly, leftward movement of arm 38 in the forward mode will cause the left-hand gripper 45 of lower gripper element 43 to move the lower run of belt 24 towards the left. Grippers 45 can be disengaged from belt 28 by simply positioning control rod 46 in a middle position between the forward and reverse modes, thereby allowing the swinging action of the seats and deck without turning paddle wheel 25.

Figure 17:
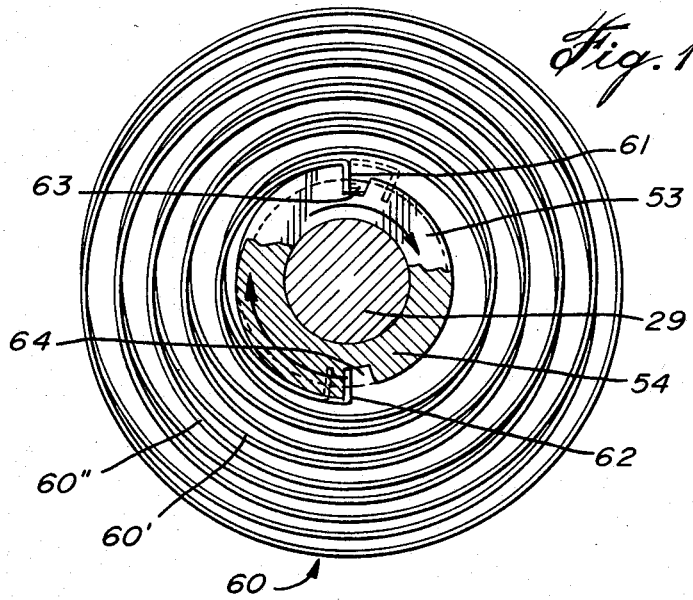
FIG. 17, on the sheet containing
Figure 16:
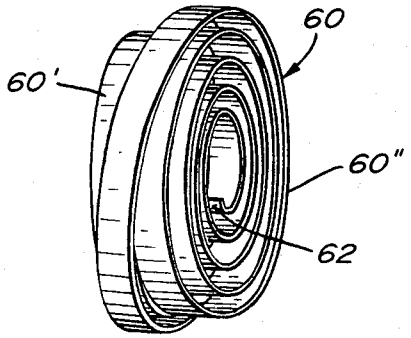
FIG. 16 is a perspective view of the spring which is one of the mechanical elements shown in FIG. 5.

It will be appreciated that, as arm 38 approaches either longitudinal limit position, it will appreciably slow down and finally momentarily stop before beginning to move in the opposite direction. Such irregular speed will, of course, be transmitted to endless belt 28, resulting in a periodic deceleration, momentary stop and acceleration of paddle wheel 25. To avoid this problem, a speed-stabilizing means, shown in FIGS. 15 to 17, is provided, consisting of: two sleeves 53, 54 freely mounted on the inner portion and outer portion of shaft 29, respectively. Pulley 26 is adapted to rotate bodily with sleeve 53 by means of a setscrew 55, while large pulley 30 rotates bodily with outer sleeve 54, being secured thereto by another setscrew 56. Both sleeves 53 and 54 are retained on shaft 29 by a nut 57 and washer 58. The inner portion of outer sleeve 54 is radially enlarged and opens at its inner circumferential edge, defining a circular cavity 59.

A spirally-wound flat spring 60 is located in the cavity 59. As seen clearly in FIGS. 16 and 17, spring 60 is made in two integral side-by-side windings 60′ and 60″ that are wound in spirally-opposite directions. Windings 60′ and 60″ have radially-inwardly-bent ends 61 and 62, respectively, these ends engaging notches 63 and 64 made in sleeves 53, 54, respectively.

Spiral spring 60 winds itself and stores energy when input pulley 26 rotates faster than output pulley 30, and this energy is released to the output pulley 30 when input pulley 26 slows down, thus accelerating sleeve 54 when arm 38 approaches and reaches a limit position. Output pulley 30 and paddle wheel 25 will therefore continue to rotate at a near-constant speed.

Craft 1 may be provided with a canopy or sun-roof (not shown) and can be transported on a trailer.

I claim:

1. A water-craft comprising two longitudinal spaced-apart pontoons, a flat rectangular base rigidly secured to the top surfaces of the two said pontoons and including longitudinal beams; a rectangular deck frame, having at each of its four corners a standard rotatively carrying a roller at its upper end portion, and mounted by a first mounting means to said base, and spaced interiorly of the longitudinal beams of said base on each side thereof; said first mounting means being embodied by four upstanding posts, one of each being rigidly secured at the four corners of said base; a longitudinally-oriented upwardly-concave first arcuate track fixedly secured to the upper end of each said post, each said roller adapted to roll in its associated said first arcuate track, whereby said deck frame can accomplish a reciprocal swinging movement relative to said base; a seat-carrying frame independently mounted by a second mounting means over said deck frame and connected thereto, being arranged for reciprocal swinging motion relative to said base and also relative to said deck frame; said deck frame rigidly supporting a deck and said seat-carrying frame rigidly supporting at least one transversely-oriented seat; a transversely-rotatably-mounted paddle wheel, journalled between the respective inner sides of the said pontoons adjacent one end thereof, to displace the craft in the water; a transmission means operatively connected to both said paddle wheel and to one of said frames, said transmission means including means to convert said reciprocal swinging movement into rotary motion.

2. A water-craft as defined in claim 1, wherein said second mounting means is embodied by said seat-carrying frame having a pair of longitudinal spaced bar members joined at their outer ends by two transverse link members; each said bar member having two rigid uprights, each located longitudinally inwardly of their respective transverse members; further having a second downwardly concave arcuate track rigidly secured to the upper end of each said upright; each said second arcuate track being adapted to swingingly engage the upper circumferential portion of its associated said roller, whereby said seat-carrying frame can accomplish said reciprocal swinging motion relative to said deck frames and to said base at twice the speed and twice the distance of said deck frame.

3. A water-craft as defined in claim 2, wherein said transmission means includes: a pair of longitudinally-spaced pulleys journalled in the inner side of one of said pontoons, a tight endless belt adapted to move longitudinally and around said pair of pulleys; one of said pulleys being operatively connected to the transverse shaft of said paddle wheel; a guide rail extending longitudinally and rigidly secured at said inner side of said pontoon, being located between the upper and lower portions of said endless belt; a vertical transmission arm having a central transverse guide wheel adapted to move on said guide rail between two longitudinal limit positions; said arm being rigidly secured to a bar member of said seat-carrying frame and being formed with a telescopic upper section, the lower portion of said arm having, pivotally secured thereto, an upper and a lower gripper element located adjacent said upper and lower portions of said endless belt respectively; each said gripper element being formed of a projecting tab and at least one radially-projecting one-way gripper engageable with the respective belt portions, whereby said endless belt is moved longitudinally by one said one-way gripper during one longitudinal displacement of said arm and moved in the same longitudinal direction by the other said one-way gripper during the opposite longitudinal displacement of said arm.

4. A water-craft as defined in claim 3, wherein each said gripper element has an additional one-way gripper angularly spaced from said first-named one-way gripper; and manually-operable control means to pivot both said tabs of each gripper element and maintain said tabs in anyone of three positions, whereby, in a first position, said first-named one-way gripper of each said gripper element will contact and move said endless belt in one direction; in a second position, neither gripper element will grip said endless belt; and, in a third position, the other one-way gripper of each gripper element will grip said endless belt and move the same in the opposite direction.

5. A water-craft as defined in claim 4, wherein a speed-stabliizing means is provided for said paddle wheel.

6. A water-craft as defined in claim 5, wherein said speed-staliizing means comprises a transverse shaft extending adjacent the shaft of said paddle wheel and having freely mounted therein an inner sleeve and an outer sleeve; said one of said pair of pulleys being rigidly secured to said inner sleeve; and a large pulley being rigidly secured to said outer sleeve; the inner portion of said outer sleeve being radially enlarged, defining a circular cavity, a spirally-wound tension spring being located in said cavity, said spring being formed of two integral side-by-side windings wound in spirally-opposite directions; one end of said spring engaging a notch made in said inner sleeve and the other end of said spring engaging a second notch made in said outer sleeve; said large pulley carrying a second endless belt that also extends around another small pulley, the latter being transversely rotatably mounted on said inner side and located on the opposite side of said paddle wheel shaft; said small pulley being operatively connected to said paddle wheel shaft by the intermediary of a gear-reduction mechanism.

* * * * *